US006153074A

United States Patent [19]

Hiraki et al.

[11] Patent Number: 6,153,074

[45] Date of Patent: Nov. 28, 2000

[54] RECORDING MATERIAL FOR ELECTRO-COAGULATION PRINTING AND METHOD FOR PRINTING THEREON

[75] Inventors: Motoko Hiraki, Warabi; Shinichi Nagasaki, Kawasaki; Masayuki Kamei, Chiba, all of Japan

[73] Assignee: OJI Paper Co., Ltd., Tokyo, Japan

[21] Appl. No.: 09/266,585

[22] Filed: Mar. 11, 1999

[30] Foreign Application Priority Data

Mar. 12, 1998 [JP] Japan ..... 10-061163

[51] Int. Cl.[7] ..... B41M 3/00; B41L 33/00

[52] U.S. Cl. ..... 204/471; 204/471; 204/546; 101/489; 101/490; 101/491; 101/93.03; 347/112

[58] Field of Search ..... 204/471, 223; 101/93–93.03, 489–491; 397/110–112

[56] References Cited

U.S. PATENT DOCUMENTS

| | | | |
|---|---|---|---|
| Re. 35,049 | 10/1995 | Atherton | 346/135.1 |
| 3,892,645 | 7/1975 | Castegnier . | |
| 4,910,084 | 3/1990 | Yamasaki et al. . | |
| 5,257,966 | 11/1993 | Watanabe | 492/37 |
| 5,538,601 | 7/1996 | Castegnier | 204/486 |
| 5,725,946 | 3/1998 | Fukushima | 428/342 |

FOREIGN PATENT DOCUMENTS

| | | |
|---|---|---|
| 0 235 700 | 9/1987 | European Pat. Off. . |
| 0 409 570 | 1/1991 | European Pat. Off. . |
| 0 747 235 | 12/1996 | European Pat. Off. . |
| 0 776 768 A2 | 6/1997 | European Pat. Off. . |

OTHER PUBLICATIONS

International Publication No. WO 90/11897 no date available.

*Paper Pulp Technology Times*, Jackson et al, Jul. 1973, with English translation of relevant portion.

*Primary Examiner*—Kathryn Gorgos
*Assistant Examiner*—J. Maisano
*Attorney, Agent, or Firm*—Arent Fox Kintner Plotkin & Kahn, PLLC

[57] ABSTRACT

A recording material having a compression modulus of elasticity of 650 kgf/cm$^2$ or less in the direction of the thickness thereof and exhibiting a maximum strain of 0.08 or more generated under pressure of 40 kgf/cm$^2$ in the thickness direction of the recording material, can record thereon electro-coagulated ink images with high clarity and color density by electro-coagulation printing.

5 Claims, 1 Drawing Sheet

RECORDING MATERIAL FOR ELECTRO-COAGULATION PRINTING AND METHOD FOR PRINTING THEREON

BACKGROUND OF THE INVENTION

1. Field of the Invention

The present invention relates to a recording material for electro-coagulation printing and a method for electro-coagulation printing on the same. More particularly, the present invention relates to a recording material usable for forming colored images having a high clarity by an electro-coagulation printing procedure, and an electro-coagulation printing method for forming colored images having a high clarity on the recording material.

2. Description of the Related Art

A basic principle of an electro-coagulation printing method (which may be referred to as an elcography) is disclosed in U.S. Pat. No. 3,892,645 and Japanese PCT Application Publication No. 4-504,688 (PCT International Publication WO 90/11897). This printing system is a non-printing plate printing system and uses an aqueous ink having such a property that it is gelled with an electric charge.

In elcography, the specific aqueous ink as mentioned above is applied between a positive cylindrical electrode and a negative electrode, and an electric differential potential corresponding to an imagewise signal is applied between the positive and negative electrodes to generate metal ions, to coagulate portions of the aqueous ink layer formed on the cylindrical electrode by the metal ions, and to cause the coagulated ink colloid to adhere to the surface of the positive cylindrical electrode. By controlling the amount and location of the coagulated ink colloid, a desired colored ink image can be formed on the positive cylindrical electrode surface, and a colored image formed from the electro-coagulated ink can be transferred onto a surface of a recording material under pressure. The constitution of a printing machine for the elcographic printing method will be explained later by referring to an attached drawing.

The elcographic printing method is characterized by not using a printing plate. A non-printing plate printing method is advantageous in that no procedure for providing a printing plate is necessary, desired images can be easily printed on a recording material surface in accordance with electric signals corresponding to the desired images, and thus various prints recording images different from each other can be easily prepared for various customers. Especially, the elcographic printing method is advantageous for various lots of prints each in a small number and different from one another.

Also, the elcographic printing method is advantageous in that since the amount of gelled ink, which corresponds to the color density of the images, is proportional to the amount of the electric charge (pulse), ink images having a fine and sharp color tone can be recorded.

Since in the elcography, no dots or halftone dots are used, the color tone of the images can be controlled by regulating the thickness of the ink layers, as in gravure printing. The thickness of the ink layers is proportional to the electric potential-applying time in accordance with the electric signals, and thus the color tone of the images can be accurately controlled. Therefore, the elcographic printing method is suitable for recording colored images.

Conventional printing paper sheets have a satisfactory absorption of oil-based inks, but are poor in absorption and transferring property of the aqueous inks usable for the elcographic printing. Also, when the elcography is applied to multi-color printing, the water component in a first colored aqueous ink applied onto the recording material surface must be quickly absorbed by the recording material, before the second colored ink is applied onto the first colored ink images. If the second colored aqueous ink is applied onto the first colored aqueous ink images before the water component of the first colored aqueous ink images is fully absorbed by the recording material, the second colored aqueous ink is not fully transferred to the recording material and, thus, the desired colored images cannot be obtained.

As mentioned above, the elcographic printing method is a very advantageous printing method. However, this method is disadvantageous in that when conventional paper sheets or printing sheets are used, the advantages of elcography cannot be fully obtained. For example, when a conventional printing paper sheet is used, prints having excellent printing qualities both in high color density tone and low color density tone cannot be obtained.

When a conventional art paper sheet is used, the resultant printed images, in a low color density region in which the amount of the coagulated ink colloid is small, exhibit a sufficient color density and thus the resultant prints are satisfactory. However, in a high color density region in which the amount of the coagulated ink colloid is large, the resultant colored ink images exhibit a poor transferring property. Also, when conventional newspaper sheets or form-printing paper sheets are used, the elcographic printing in the high color density region, in which the amount of the coagulated ink colloid is large, can be satisfactory effected. However, in the low color density region in which the amount of the coagulated ink colloid is small, the elcographic printing is disadvantageous in that non-printed white spots and reduced color density spots are formed.

SUMMARY OF THE INVENTION

An object of the present invention is to provide a recording material for electro-coagulation printing, which has excellent ink-transferring property and ink absorption and can be recorded with ink images with high clarity and sharpness and an electro-coagulation printing method for the above-mentioned recording material.

Another object of the present invention is to provide a recording material for electro-coagulation printing especially suitable for multi-color printing, and an electro-coagulation printing method for the above-mentioned recording material.

The above-mentioned object can be obtained by the recording material of the present invention for electro-coagulation printing and by the electro-coagulation printing method of the present invention.

The recording material of the present invention for the electro-coagulation printing has a compression modulus of elasticity of 650 kgf/cm$^2$ or less in the direction of the thickness of the recording material, and exhibits a maximum strain of 0.08 or more generated under a pressure of 40 kgf/cm$^2$ in the thickness direction of the recording material.

The recording material of the present invention for electro-coagulation printing has a recording surface which preferably has a roughness maximum height (Ry) of 35 $\mu$m or less at a standard reference length of 2.5 mm, determined in accordance with Japanese Industrial Standard B 0601.

The recording material of the present invention for electro-coagulation printing preferably comprises at least one member selected from the group consisting of paper sheets, synthetic paper sheets, nonwoven fabrics and film sheets.

The recording material of the present invention for electro-coagulation printing preferably comprises a support and an ink receiving layer formed on a surface of the support and comprising a pigment and a binder.

In the recording material of the present invention for electro-coagulation printing, the ink receiving layer is preferably present in an amount of 3 to 30 g/m$^2$ or less.

The recording material of the present invention for electro-coagulation printing preferably has a recording surface which has an arithmetical mean roughness (Ra) of 4 $\mu$m or less, determined in accordance with Japanese Industrial Standard B 0601.

The recording material of the present invention for electro-coagulation printing may be one produced by subjecting a pulp slurry comprising a mechanical pulp to a paper-forming procedure in which an internal sizing agent is added into the pulp slurry, or at least one member selected from resins and external sizing agents is coated on or impregnated in the resultant paper sheet.

An electro-coagulation printing method of the present invention using the recording material of the present invention as mentioned above wherein an ink comprising a polymeric resin, a coloring material and a medium is fed between a plurality of needle-shaped electrodes and a portion of a rotary cylindrical metal electrode facing the needle-shaped electrodes, to form an ink layer on the rotary cylindrical metallic electrode;

electric differential potentials are applied imagewise between the needle-shaped electrodes and the rotary cylindrical metal electrode, to generate metal ions and coagulate the ink layer imagewise by the metal ions;

non-coagulated potions of the ink layer are removed from the rotary cylindrical metal electrode; and the coagulated imagewise ink portions on the rotary cylindrical metal electrode are transferred onto a recording surface of the recording material.

DESCRIPTION OF THE PREFERRED EMBODIMENTS

Figure 1:
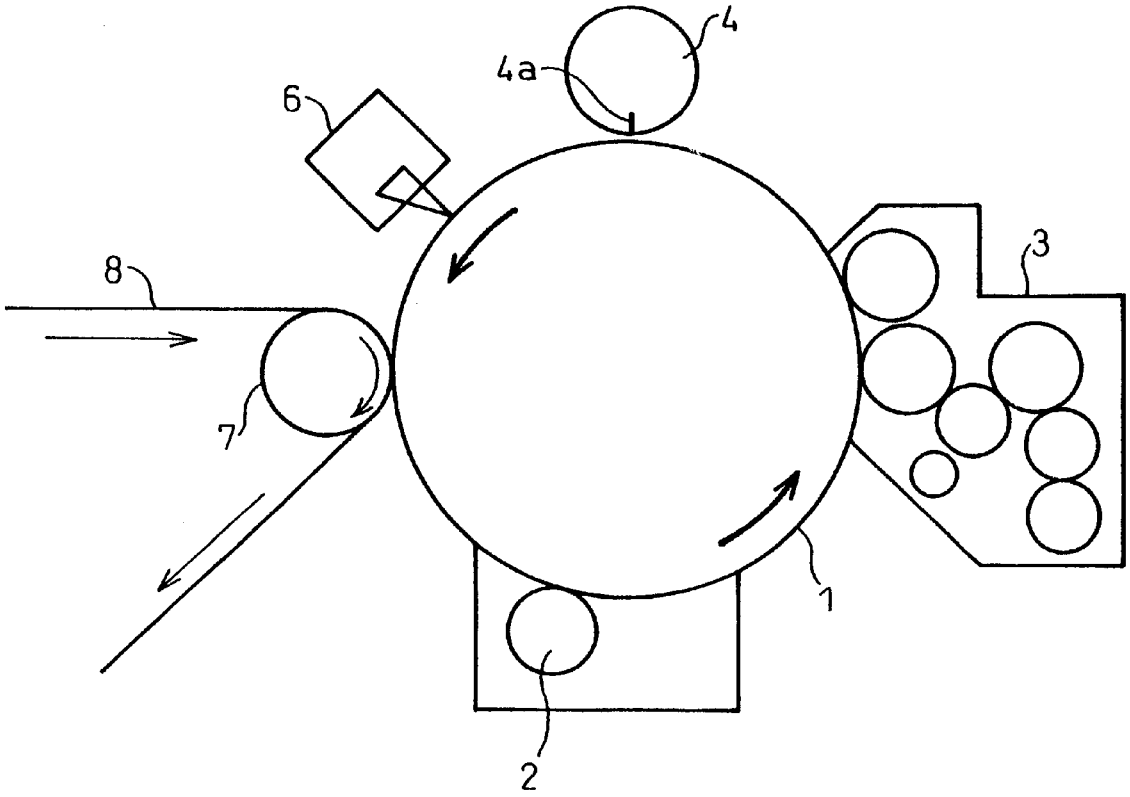
FIG. 1 is an explanatory side view of an embodiment of the electro-coagulation printer to which the recording material of the present invention is applied.

An embodiment of an electro-coagulation printer will be explained by referring to the attached drawing below.

In FIG. 1, a metal cylinder 1 is used as a positive electrode and it rotates in the direction shown by thick arrows in FIG. 1. The peripheral surface of the positive rotary cylindrical metal electrode 1 is cleaned by a cleaning means 2, and is then coated with a corrosion-preventive coating agent by a conditioning means 3.

A portion of the surface-conditioned peripheral surface of the positive rotary cylindrical metal electrode faces a plurality of needle-shaped negative electrodes 4*a* electrically insulated from each other and independently from each other embedded in and fixed to a print head 4. Into the clearance between the peripheral surface of the positive rotary cylindrical metal electrode 1 and the needle-shaped negative electrodes 4*a*, an electro-coagulatable ink is applied from an ink feeder to form an ink layer on the peripheral surface of the positive rotary cylindrical metal electrode 1. Then electric differential potentials are applied imagewise between the positive and negative electrodes, in accordance with electric signals corresponding to the images to be printed, to generate metal ions from the positive cylindrical metal electrode.

The ink layer on the positive cylindrical metal electrode is electrically gelled and coagulated imagewise by the metal ions. The coagulated ink portions are cohered imagewise on the peripheral surface of the positive cylindrical metal electrode 1, and non-coagulated ink portions are selectively removed from the coagulated ink portions by a wiper 6.

A recording material 8 is brought in the direction shown by the thin arrows into contact with the peripheral surface of the positive cylindrical metal electrode 1 and is pressed toward the peripheral surface of the electrode 1 by a press roll 7. The coagulated colloidal ink images carried on the peripheral surface of the electrode 1 are transferred to the recording surface of the recording material 8.

When multi-colored images are printed, the above-mentioned electro-coagulation printing procedures are repeatedly carried out for each of the multiple colored inks.

In the electro-coagulation printing, the recording material is required to be able to rapidly absorb the printing ink, and to have pore spaces for absorbing therein the ink therein. Also, it was found that the cushioning property and the surface property are very important for the recording material for electro-coagulation printing. The cushioning property of the recording material can be represented by a compression modulus of elasticity of the recording material in a direction of the thickness of the recording material, for example, a paper sheet, namely in a Z direction, and a maximum strain of the recording material generated under a pressure of 40 kgf/cm$^2$ in the thickness direction of the recording material.

The compression modulus of elasticity and maximum strain can be measured by the method for measuring compression properties, disclosed by M. Jackson and L. Estroem, Paper Pulp Technology Times, July 1973, page 33, the right column.

In the electro-coagulation printing, gelled ink images must be transferred onto and absorbed in a recording material. The ink receiving surface (recording surface) of the recording material must have a plurality of pores in which the transferred ink is received and absorbed.

The inventors of the present invention made extensive studies on the methods for measuring the ink-receiving pores in the recording material for the electro-coagulation printing. As a result, the inventors have found that the important properties of the recording material for the electro-coagulation printing due to the ink receiving pores are a compression modulus of elasticity of the recording material in the direction of thickness (the Z direction) of the recording material and a maximum stress of the recording material in the Z direction under a pressure of 40 kgf/cm$^2$.

When the compression modulus of elasticity is 650 kgf/cm$^2$ or less, preferably 600 kgf/cm$^2$ or less, more preferably 150 to 600 kgf/cm$^2$ in the Z direction, and the maximum strain under pressure of 40 kgf/cm$^2$ in the Z (thickness) direction is 0.08 or more, preferably 0.1 or more, more preferably 0.1 to 0.4, the resultant recording material of the present invention exhibits excellent ink absorption rate and capacity.

Also, the recording material of the present invention preferably has a recording surface having a maximum height (Ry) of 35 $\mu$m or less, more preferably 10 to 30 $\mu$m, at a standard reference length of 2.5 mm, determined in accordance with Japanese Industrial Standard B 0601. In this case, the resultant ink images recorded on the recording material have a high color density, no colored ink gaps, a high reproducibility of ink dots and an excellent print quality. By adjusting the compression modulus of elasticity to 650 kgf/cm$^2$ or less, preferably 600 kgf/cm$^2$ or less, more preferably 150 to 600 kgf/cm$^2$, in the Z direction (the thickness direction), and the maximum strain under 40 kgf/cm$^2$ to 0.08 or more, preferably 0.10 or more, more preferably 0.1 to 0.4, in the Z direction, the objects of the present invention can be attained. The lower the compression modulus of elasticity, the easier the compression of the recording material. There is no specific upper limit to the maximum strain. Usually, the maximum strain may be about 0.5 at highest.

By measuring the maximum strain of the recording material in the Z direction under a pressure of 40 kgf/cm$^2$, the amount of pores present in the recording material can be known, and thus the ink absorption capacity of the recording material can be controlled in response to the result of the maximum strain measurement of the recording material. The higher the maximum strain, the larger the total amount of the pores present in the recording material and useful for the absorption of the ink, and thus the higher the absorption and transfer rates of the ink by the recording material.

In the electro-coagulation printing system, the coagulated colloidal ink images cohered onto the peripheral surface of the metal cylinder serving as a positive electrode are transferred to the recording material. Therefore, the recording material is brought into contact with the peripheral surface of the positive electrode on which the coagulated colloidal ink images are carried, and is pressed at the back surface thereof by a press roll, to transfer the coagulated colloidal ink images to the recording material. Namely, this system is referred to a contact-transfer system. During the ink absorption and image-transfer procedure, the recording material is compressed by contact with the peripheral surface of the metal cylinder under a pressure applied by the press roll, and after the recording material is released from the compression force by the press roll, the volume of the recording material is restored to the original by the restoring force of the recording material per se.

Therefore, the recording material preferably has a high cushioning property by which the recording material can be easily compressed and restored to the original state. To rapidly absorb the coagulated colloidal ink, the recording material of the present invention has a compression modulus of elasticity controlled to 650 kgf/cm$^2$ or less, preferably 600 kgf/cm$^2$ or less, more preferably 150 to 600 kgf/cm$^2$, in the Z direction. Also, the higher the strain of the recording material under compression in the Z direction, the higher the absorption capacity of the recording material for the coagulated colloidal ink.

In a monochromatic printing, to obtain a good print, the recording material of the present invention exhibits a maximum strain of 0.08 or more, preferably 0.10 or more, more preferably 0.1 to 0.4, under a pressure of 40 kgf/cm$^2$ in the Z direction.

When the compression modulus of elasticity is too high, and the maximum strain is too low, the resultant recording material for the electro-coagulation printing exhibit an unsatisfactory transfer efficiency of the coagulated colloidal ink in a high color density, and thus the resultant print is unsatisfactory in print quality.

When a conventional printing paper sheet having a high gloss is used in the electro-coagulation printing, in a low color density-printing region, the resultant colored image is satisfactory in color density. However, in a moderate to high color density printing regions, the ink absorption capacity of the printing paper sheet is insufficient and thus the coagulated colloidal ink images cannot be satisfactorily transferred to the printing paper sheet. These disadvantages are derived from the fact that the compression modulus of elasticity of the paper sheet is more than 650 kgf/cm$^2$ in the Z direction, and the maximum strain of the paper sheet is less than 0.08 under a pressure of 40 kgf/cm$^2$ in the Z direction. In the recording material of the present invention, the recording surface exhibits a high gloss and can be recorded with the ink images having a high color density even in the low color density printing region.

In the electro-coagulation printing system, it is assumed that the ink gelled between the positive and negative electrodes has a water content of 40 to 60%. Thus the gelled ink is harder than the conventional printing ink and is difficult to transfer. The inventors have found that the recording material should absorb the water component contained in the gelled ink to promote the transfer of the gelled ink. For this necessity, the recording material of the present invention having the above-mentioned cushioning property due to the high porosity can advantageously absorb the water component in the gelled ink to promote the transfer of the gelled ink.

To obtain a high print quality including no ink gaps, high color density, and a high reproducibility of ink dots and a true circle form of the dots, it is preferable that the roughness maximum height (Ry) at a random ten points at a standard reference length of 2.5 mm, of the recording surface of the recording material of the present invention is controlled to 35 $\mu$m or less, more preferably 30 $\mu$m or less, still more preferably 10 to 30 $\mu$m, determined in accordance with Japanese Industrial standard B 0601 concerning a surface roughness. When the maximum height (Ry) is more than 35 $\mu$m, uneven absorption of the coagulated colloidal ink, unsatisfactory reproducibility of the colored ink images in a low color density printing region in which the amount of the ink is small, ink gaps in the images and reduction in the color density of the images may occur.

In the present invention, it has been formed that the structure of the recording material and the surface property of the recording surface are very important.

In the structure of the recording material, the number of pores must be large. In the printing, since the coagulated ink penetrates into the recording material, the recording material must have empty spaces corresponding to the volume of the penetrated ink. Also, air present in the empty spaces must be rapidly discharged from the recording material when the coagulated ink penetrates into the recording material.

As a method of measuring the velocity of movement of air, the gas permeability testing method (Japanese Industrial Standard P 8117) has been applied. As a result, however, it was found that particularly in the recording material in which a synthetic region film sheet was used as a substrate, substantially no correlation, between the measured air permeability value of the recording material and the resultant print quality of the recording material, was found.

However, it has been found that in the recording material of the present invention, when the arithmetical mean roughness (Ra) of the recording surface is controlled to 4 $\mu$m or less, preferably 3 $\mu$m or less, more preferably 1.5 to 3.0 $\mu$m, determined in accordance with Japanese Industrial Standard B 0601, the resultant ink images on the recording surface exhibit an excellent print quality even in the low color density printing region.

Usually, in the low color density printing region, the concavities formed on the recording surface are difficult to smoothly fill by the transferred coagulated ink. Accordingly, to obtain a high print quality including no ink gaps, a high color density, and a high reproducibility of the ink dots, the arithmetical mean roughness (Ra) of the recording surface is preferably controlled to 4 μm or less, more preferably 3 μm or less, still more preferably 1.5 to 3.0 μm. When the Ra is more than 4 μm, the resultant recording surface may exhibit an uneven absorption of the coagulated colloidal ink, a poor reproducibility of the ink dots in the low color density printing region in which the ink is used in a small amount, the dots have a poor circle form a ink gaps and a reduction in the color density of the printed ink images.

The conventional printing paper sheet having a high gloss can be printed with ink images having a high color density in the low color density printing region. However, in the moderate and high color density printing regions, the conventional paper sheet has an insufficient ink absorption capacity and thus the transfer of the ink images is insufficient. Compared with this, the recording material of the present invention can be satisfactorily printed with the coagulated ink images having very high quality in the range of from low color density to high color density.

There is no limitation to the thickness of the recording material. Usually, the recording material of the present invention is a sheet material having a thickness of 40 μm to 300 μm.

Usually, the recording material or the support of the recording material is preferably formed from at least one member selected from paper sheets, synthetic paper sheets, nonwoven fabrics, and film sheets, as long as the necessary compression modulus of elasticity and maximum strain of the present invention is attained in these materials. The paper sheets include, for example, acid paper sheets, neutral paper sheets, wood pulp paper sheets, non-wood pulp paper sheets, mechanical pulp paper sheets and chemical pulp paper sheets and newspaper sheets.

The nonwoven fabrics include nonwoven fabrics comprising at least one member selected from natural fibers, for example, pulp fibers and cotton fibers, semi-synthetic fibers, for example, rayon fibers, and synthetic fibers, for example, polyester, polyolefin and polyamide fibers. These fibers can be used alone or in combination of two or more thereof. The nonwoven fabrics can be produced by conventional nonwoven fabric-forming methods in which the fibers are formed into a web form by, for example, wet methods, card methods or air-lay methods, and then the web is subjected to a fiber-intertwining procedure, by, for example, thermal bonding methods, resin-bonding methods, needle-punching methods, and spun-lacing methods. Also, nonwoven fabrics can be produced from thermoplastic resins, for example, polyolefin resins, polyester resins and polyamide resins by spun spun-bonding methods, melt-blow methods or flash-spinning methods. These nonwoven fabrics produced by the conventional methods can be used alone or in a laminated product in which two or more nonwoven fabrics are laminated on each other. Further, the nonwoven fabrics may be laminated with a film, for example, polyolefin film, for example, polyethylene or polypropylene film, or polyester film.

The film sheet may be selected from thermoplastic resin film sheets. The thermoplastic resin may be selected from those comprising, as a principal component, at least one member selected from polyolefin resins, for example, polyethylene, polypropylene, ethylene-propylene copolymer and ethylene-vinyl acetate copolymer resins, and other thermoplastic resins, for example, polystyrene, polyacrylate ester polymer or copolymer resins. The film sheet may include paper-like sheets, namely synthetic paper sheets, produced by forming a film from a mixture of a thermoplastic resin and fine inorganic pigment particles, and by biaxially drawing the film. The resultant synthetic paper sheets have a paper-like hand.

The paper sheet for the recording material or the support sheet thereof is prepared from a material pulp selected from chemical pulps (for example, NBKP, LBKP, NKP, LKP etc.), mechanical pulps (for example, GP, CGP, RGP, PGW, TMP, etc.) and used paper pulps (DIP, etc.), which may be employed alone or in a mixture of two or more.

The PGW, namely pressure stone-ground wood pulp contains no fiber bundles and has a high flexibility. Also, in the fiber length distribution of the PGW, medium length pulp fibers are contained in a large amount, and the pulp fibers as are fibrillated. Therefore, by using the PGW, the smoothness and the compressibility of the resultant papar sheet can be enhanced.

The woods for the TMP, namely thermomechanical pulp are preferably selected from softwoods, for example, pine, Japanese red pine and merkus pine woods. In the production of the TMP, since the wood chips are softened by a pre-steaming and the softened wood chips are subjected to a refining procedure under pressure, the resultant pulp fibers have a high degree of fiber opening, a low degree of fiber cutting, a low degree of fiber-bundling and a long fiber length. Therefore by including the TMP in the paper sheet, the resultant paper sheet exhibits a reduced bulk density. The TMP is useful for producing a paper sheet having a high bulkiness.

The paper sheets containing the mechanical pulp include newspaper sheets. The newspaper sheets include paper sheets containing internally added filler, for example, white carbon, internally added rosin size and/or aluminum sulfate, and externally applied sizing agent, for example, starch, polyacrylamide and/or styrene-acrylic acid copolymer in an amount of 0.03 to 1 $g/m^2$.

In the paper sheets, the lower the Lunkel ratio of the pulp fibers, the lower the resistance of the resultant sheet to compression and the lower the compression modulus of elasticity of the sheet. Generally, the Lunkel ratio of the softwood pulp fibers is low. To control the compression modulus of elasticity of the recording paper sheet to the necessary value of the present invention, the paper sheet is preferably formed from the softwood pulp fibers. For example, the paper sheet preferably comprises 20% or more, more preferably 30% or more, of the softwood pulp fibers. When a mechanical pulp, for example, GP is used, the resultant paper sheet exhibits a lower compression modulus of elasticity than that from the chemical pulp fibers.

There is no limitation to the degree of beating of the pulp fibers. Usually, the Canadian Standard Freeness of the pulp for the paper sheets is preferably controlled to about 300 to 600 ml.

In the production of the support paper sheet for a coated paper sheet, optionally an additive for paper-formation, including a paper strength-enhancing agent, sizing agent, filler and/or yield-enhancing agent, is added to a paper-forming pulp slurry, the ash content of the pulp slurry is controlled to such a level that the resultant paper sheet has an ash content of about 15% or less, and the resultant pulp slurry is fed into a paper-forming machine. The ash content of the paper sheet is preferably 1 to 12%.

Also, to adjust the maximum height (Ry) of the recording surface of the recording material of the present invention to 35 μm or less at a standard reference length of 2.5 mm, preferably the type of the materials of the recording material, the mixing ratio of the pulps different from each other, the type and amount of the fillers and the conditions of the calendering treatment are regulated so that the resultant recording material has the necessary properties for the present invention.

Further, the sheet materials for the recording material of the present invention are optionally coated or impregnated with the resin or sizing agent of which examples will be shown later.

The method of sizing the paper sheet with a sizing agent includes the following methods.

(1) An internal sizing agent is mixed into a pulp slurry, and the mixed pulp slurry is subjected to a paper forming process.

(2) An external sizing agent is applied to the paper sheet by using a coating apparatus, for example, a two roll sizepress or gate roll.

In the method (1), the internal size of the paper sheet can be imparted to the paper sheet by sizing the paper sheet with an internal sizing agent, for example, rosin sizing agents, synthetic sizing agents, alkenyl succinic anhydride (ASA) and alkylketene dimers; and the interlayer strength of the paper sheet can be enhanced using a paper strength-enhancing agent, for example, cation-modified starches, polyacrylamide and polyacryl-epichlorolydrin.

As an external surface treatment agent (2), resins capable of enhancing the surface strength of the paper sheet, for example, an aqueous starch solution, a weak cationic acrylate emulsion, an aqueous solution of an ammonium salt of a styrene-maleic acid copolymer and an aqueous polyvinyl alcohol solution, or agents for enhancing water resistance of paper sheet, can be employed.

In an embodiment, the recording material of the present invention comprises a support comprising a sheet material and an ink receiving layer formed on a surface of the support and comprising, as principal component, a pigment and a binder. This type of recording material is referred as a coated paper-type recording material.

The pigment usable for the ink receiving layer is not limited to a specific type of pigment. Usually, the pigment comprises at least one member selected from, for example, inorganic pigments, for example, zeolite clay, kaolin, calcium carbonate, magnesium carbonate amorphous silica, satin white, aluminum hydroxide and titanium dioxide pigments, and organic pigments, for example, urea-formaldehyde, polypropylene (PP), polystyrene, and acrylic resin pigments. They can be used alone or in a mixture of two or more thereof. Among the above-mentioned pigments, to enhance the ink-transfer property of the ink receiving layer, porous pigments having a high water absorption are preferably employed. For example, the porous pigment should have a BET specific surface area of 40 to 1,000 $m^2/g$.

Also, among the above-mentioned pigments, the amorphous silica and calcium carbonate pigments which have a good compatibility with the hydrophobic moieties of the ink, are preferably employed. To adjust the compression modulus of elasticity and the maximum strain to desired values, respectively, the pigment is preferably selected from polypropylene resin pigments which are preferably in the form of fine hollow particles, and low specific gravity pigments, for example, amorphous silica and zeolite pigments.

There is no limitation to the particle size of the pigments. Usually, the pigment particles have an average particle size of 0.01 $\mu$m to 30 $\mu$m, preferably 0.01 $\mu$m to 15 $\mu$m. When the pigment having a large particle size is contained in a large amount in the ink receiving layer, the recording surface may have a high maximum height (Ry).

The binder for the ink receiving layer comprises at least one member selected from polyvinyl alcohol, polyvinyl alcohol derivatives, for example, silyl-modified polyvinyl alcohol and cation-modified polyvinyl alcohol, polyvinyl pyrrolidone, celluose derivatives, for example, methyl cellulose, starch, starch derivatives, for example, oxidized starches, esterified starches and cation-modified starches, casein, conjugated diene copolymers, for example, SBR and acrylic resins. These polymeric materials may be employed alone or in a mixture of two or more thereof.

In the present invention, various known technologies, for example, imparting a cationic substance to the recording material to fix the ink in the recording material and to enhance the water-resistance of the fixed ink images, may be applied to the recording material.

There is no limitation to the mixing ratio of the pigment to the binder. Usually, the binder is used in an amount of 10 to 700 parts by weight, preferably 10 to 400 parts by weight, more preferably 10 to 100 parts by weight, per 100 parts by weight of the pigment.

Also, there is no limitation to the coating amount of the ink receiving layer. Usually, the ink receiving layer is formed in an amount of 1 $g/m^2$ to 30 $g/m^2$, preferably 3 to 30 $g/m^2$, more preferably 3 to 15 $g/m^2$.

The ink receiving layer may be formed by a conventional coating means, for example, a two roll sizepress, a blade metalling sizepress, a rod metalling sizepress, a gate roll coater, a rod blade coater, a blade coater, an air knife coater, a roll coater, a brush coater, a champlex coater, a bar coater, a gravure coater, a curtain coater or a die coater or a by a cast-coating method.

To control the above-mentioned compression modulus of elasticity and maximum strain, in the thickness direction of the recording material, to the desired values thereof, the type of the component materials of the ink receiving layer, the mixing ratio of the pigment to the binder, and the conditions of the calendering treatment should be designed or controlled.

In electro-coagulation printing, the recording materials are classified into various grades, as in usual printing. Namely, the recording material for the electro-coagulation printing includes non-coated sheet-type and coated sheet-type recording materials. Generally speaking, the coated sheet type recording materials are advantageous in the high color density of the recorded ink images.

The ink receiving layer may be in a single layered structure or a multi-layered structure.

Particularly, when a coating layer having a high smoothness, a high gloss and a high transparency is formed, as a recording surface layer, on a support of a recording material, the ink images recorded in the recording surface layer exhibit a high recording quality. To enhance the gloss of the recording surface layer, the surface layer is preferably formed by a cast-coating method using a high gloss casting surface. Also, a surface-smoothing treatment, for example, machine calender, super calender, or heat calender treatment may be applied to the surface layer to enhance the gloss thereof. However, the gloss-enhancing treatment should be effected to such an extent that the maximum strain of the resultant recording material in the thickness direction thereof is kept within the range defined in the present invention.

The ink for the electro-coagulation printing comprises an electroconductive medium, for example, an aqueous medium, a polymeric material and a coloring material, for example, a coloring pigment. The polymeric material comprises at least one polymeric substance coagulatable by metal ions generated by electric current, and selected from, for example, gelatin, polyacrylic acid, and polyacrylamide. The polymeric substance absorbs metal ions, is cross-linked by the absorbed metal ions to coagulate and the coagulated polymeric substance precipitates. In principle, when an electric differential potential is applied between the positive and negative electrodes, to generate an electric current flowing between the electrodes, the metal ions are generated from the positive metal cylindrical electrode and penetrate into the ink layer to coagulate the ink layer.

EXAMPLES

The present invention will be further illustrated by the following examples which are merely representative and do not limit the scope of the present invention in any way.

Example 1

An aqueous pulp slurry was prepared from 30 parts by weight of a softwood bleached kraft pulp beaten to a Canadian standard freeness (CSF) of 620 ml, 40 parts by weight of a thermochemical pulp having a Canadian standard freeness of 120 ml and 30 parts by weight of a deinked, used newspaper pulp (DIP) having a Canadian standard freeness of 154 ml and containing 2 parts by weight of aluminum sulfate, 0.2 parts by weight of a rosin sizing agent and 1 part by weight of white carbon. The aqueous pulp slurry was processed in a twin wire newspaper-forming machine.

The resultant recording paper sheet for electro-coagulation printing, had a basis weight of 43 g/m$^2$, a St öckigt sizing degree of 0 second and a Bekk smoothness of 50 seconds.

Example 2

A support paper sheet having a basis weight of 120 g/m$^2$ was prepared from an aqueous pulp slurry comprising a pulp mixture of 50 parts by weight of a hardwood bleached kraft pulp (LBKP) with 50 parts by weight of a softwood bleached kraft pulp (NBKP), and beaten to a C.S.F. of 450 ml, and an additive consisting of 10 parts by weight of a calcium carbonate pigment, 0.2 part by weight of a paper strength-enhancing agent (trademark: POLYSTRON 191, made by ARAKAWA KAGAKUKOGYO K.K.) and 0.3 part by weight of a alkenyl-succinic anhydride-internal sizing agent (trademark: FIVERAN-81, made by OJI NATIONAL K.K.), and mixed into the pulp mixture, by a wire paper-forming machine.

An aqueous coating liquid prepared by dispersing or dissolving 100 parts by weight of an amorphous silica pigment (trademark: Finsil X-45, made by K.K. TOKUYAMA) having an average particle size of 3.9 $\mu$m and a specific surface area of 340 m$^2$/g and 50 parts by weight of polyvinyl alcohol (trademark: KURARAY POVAL PVA-110, made by KURARAY K.K.) in 500 parts by weight of water. The coating liquid was coated on a surface of the support paper sheet by using a bar coater and dried to form an ink receiving layer in a dry solid amount of 5 g/m$^2$.

A recording material for electro-coagulation printing was obtained.

Example 3

An aqueous coating liquid having a solid content of 18% by weight was prepared from a pigment consisting of 50 parts by weight of an amorphous silica (trademark: Finsil X-45, made by K.K. TOKUYAMA) and 50 parts by weight of a zeolite (trademark: TOYOBUILDER, made by K.K. TOSO) having an average particle size of 1.5 $\mu$m, and a binder consisting of 20 parts by weight of a silyl-modified polyvinyl alcohol (trademark: R1130, made by KURARAY K.K.) and 10 parts by weight of a cationic resin (trademark: NEOFIX E117, made by NIKKA KAGAKU K.K.).

The coating liquid was coated on a surface of the same support paper sheet as in Example 2 by using a bar coater, and dried to form an ink receiving layer in a dry solid amount of 10 g/m$^2$.

A coating liquid for a gloss layer having a solid content of 25% by weight was prepared from 100 parts by weight of a copolymer of a styrene-acryl resin with colloidal silica and having a glass transition temperature of 75° C., 20 parts of fine calcium carbonate particles having a primary particle size of 0.02 $\mu$m, a secondary particle size of 0.2 $\mu$m and a BET specific surface area of 100 m$^2$/g (trademark: CPL410-6, made by ), 5 parts by weight of a thickening and dispersing agent consisting of an alkylvinylether-maleic acid derivative copolymer and 3 parts by weight of a release agent.

The coating liquid for the gloss layer was coated on the above-mentioned ink receiving layer by using a roll coater, and the coated liquid layer was immediately brought into contact with a peripheral surface of the mirror-finished cast drum having a surface temperature of 85° C. under pressure, and dried to form a gloss layer. A gloss cast paper-type recording sheet was obtained. The gloss layer had a solid amount of 8 g/m$^2$.

A recording material for electro-coagulation printing was obtained.

Example 4

The same support paper sheet as in Example 2 was employed as a recording material for electro-coagulation printing.

Comparative Example 1

A trade printing paper sheet (trademark: OK SUPER ART M, made by OJI PAPER CO., LTD) having a coating layer comprising, as a principal component, calcium carbonate, was employed as a recording material for electro-coagulation printing.

Comparative Example 2

A trade printing paper sheet (trademark: SA KINFUJI, made by OJI PAPER CO., LTD) having a coating layer comprising, as a principal component, kaolin, was employed as a recording material for electro-coagulation printing.

Example 5

A support paper sheet having a basis weight of 100 g/m$^2$ was prepared from an aqueous pulp slurry comprising a pulp mixture of 55 parts by weight of a softwood bleached kraft pulp (NBKP) with 45 parts by weight of a hardwood bleached kraft pulp (LBKP), and beated to a C.S.F. of 400 ml, and an additive consisting of 10 parts by weight of a calcium carbonate pigment, 0.3 part by weight of a paper strength-enhancing agent (trademark: POLYSTRON 191, made by ARAKAWA KAGAKUKOGYO K.K.), 0.3 part by weight of a sizing agent (trademark: SIZEPINE S-300, made by ARAKAWA KAGAKU K.K.) and 2.0% by weight of aluminum sulfate, and mixed into the pulp mixture, by a wire paper-forming machine.

An aqueous coating liquid prepared by dispersing or dissolving 100 parts by weight of a silica pigment (trademark: Finsil X-37, made by K.K. TOKUYAMA) having an average particle size of 3.7 μm and a specific surface area of 260 $m^2/g$ and 60 parts by weight of polyvinyl alcohol (trademark KURARAY POVAL PVA-110, made by KURARAY K.K.) in 500 parts by weight of water. The coating liquid was coated on a surface of the support paper sheet by using a bar coater and dried to form an ink receiving layer in a dry solid amount of 2.5 $g/m^2$. The resultant coated paper sheet was subjected to a calendering treatment under a linear pressure of 20 kg/cm.

A recording material for electro-coagulation printing was obtained.

Example 6

A paper sheet having a basis weight of 100 g/m was prepared from an aqueous pulp slurry comprising a pulp mixture of 20 parts by weight of a softwood bleached kraft pulp (NBKP) with 80 parts by weight of a hardwood bleached kraft pulp (LBKP), and beaten to a C.S.F. of 450 ml, and an additive consisting of 10 parts by weight of a calcium carbonate pigment, 0.3 part by weight of a paper strength-enhancing agent (trademark: POLYSTRON 191, made by ARAKAWA KAGAKUKOGYO K.K.), 0.3 part by weight of a sizing agent (trademark: SIZEPINE S-300, made by ARAKAWA KAGAKU K.K.) and 2.0 parts by weight of aluminum sulfate, and mixed into the pulp mixture, by a wire paper-forming machine.

The resultant paper sheet was employed as a recording material for electro-coagulation printing.

Tests

The recording materials produced in Examples 1 to 5 and Comparative Examples 1 to 3 were subjected to the following tests.

(1) Definition of the compression modulus of elasticity and maximum strain

When an end of a recording material having a thickness $L_0$ in μm is fixed, and the opposite end portion of the recording material is compressed in the thickness (Z) direction of the recording material under a compression force F, to an extent that the thickness of the compressed portion reaches a value L, the strain γ of the recording material in the Z direction is determined in accordance with the equation (1):

$$\gamma=(L_0-L)/L_0 \quad (1)$$

When the compressed portion of the recording material having a thickness L is in an area A, the pressure σ applied to the compressed portion having the area A per unit area ($cm^2$) is determined in accordance with the equation (2):

$$\sigma=F/A \quad (2)$$

In accordance with the Hooke's law, the pressure σ is proportional to the strain γ. Therefore, when the recording material has a compression modulus of elasticity E in the Z direction of the recording material, the strain γ and the compression modulus of elasticity E in the Z direction are determined in accordance with the equations (3) and (4), respectively:

$$\gamma=\sigma/E \quad (3)$$

$$E=\sigma/\gamma \quad (4)$$

(2) Measurement of compression modulus of elasticity

A specimen having a length of 6 cm and a width of 6 cm was prepared from a recording material, and compressed in the Z direction thereof by using a tensile tester (trademark: STROGRAPH M-2, made by TOYO SEIKI K.K.) in a compression area of 2.55 $cm^2$ under a pressure of 102 kgf at a compression rate of 0.1 mm/minute. The compression modulus of elasticity of the specimen was determined in accordance with the equations (1), (2) and (4).

(3) Measurement of maximum strain

The same compression test as in the measurement of the compression modulus of elasticity was carried out and the maximum strain of the specimen in the Z direction under a pressure σ of 40 kgf/cm was determined in accordance with the equation (1) or (3).

(4) Measurement of maximum height (Ry) of surface roughness of recording surface The Ry was measured in accordance with Japanese Industrial Standard B 0601 at ten random points on the recording surface of a recording material at a reference length of 2.5 mm, by using a universal surface condition tester (Model: SE-3C, made by K.K. KOSAKA KENKYUSHO).

Determination of $R_y$ $R_y$ shall be such that only the reference length is sampled from the roughness curve in the direction of mean line, the distance between the top of profile peak line and the bottom of profile valley line on this sampled portion is measured in the longitudinal magnification direction of roughness curve and the obtained value is expressed in micrometer (μm).

(5) Measurement of arithmetical mean roughness (Ra)

The measurement of the Ra was carried out in accordance with Japanese Industrial Standard B 0601.

Determination of $R_a$ $R_a$ means the value obtained by the following formula and expressed in micrometer (μm) when sampling only the reference length from the roughness curve in the direction of mean line, taking the X-axis in the direction of mean line and the Y-axis in the direction of longitudinal magnification of this sampled part and the roughness curve is expressed by y=f(x):

$$R_a = \frac{1}{l}\int_0^l |f(x)|dx$$

where, 1: reference length (6) Evaluation of printing property (a) Color density of ink images A recording material was printed in a single color by using an electro-coagulation printer (made by ELCORSY CO.).

The color densities of the printed images in a low color density printing region and in a high color density printing region were determined by using a Macbeth color density tester (model: RD914).

The ink used in the electro-coagulation printing comprised a medium consisting of water, a polymeric material and a coloring pigment.

(b) Prevention of color-gaps

In the printed color images in the moderate color density printing region, the amount of color-gaps was evaluated by the naked eye observation, into the following classes.

| Class | color-gaps |
|---|---|
| 4 | No color-gaps are found. |
| 3 | Small color-gaps are found. |
| 2 | Certain color-gaps are found. |
| 1 | Large color-gaps in a large number are found. |

(c) Ink-transferring property

The single colored ink images printed on the recording material were evaluated, by the naked eye observation, into the following classes.

| Class | Ink-transfer |
|---|---|
| 4 | In all the low to high color density printing regions, the ink images are perfectly transferred. |
| 3 | In the low to moderate color density printing regions, the ink images are satisfactorily transferred. However, in the high color density printing region, the ink images are not fully transferred. |
| 2 | In the low color density printing region, the ink images are satisfactorily transferred, but in the moderate to high color density printing regions, the ink image transfer is unsatisfactory. |
| 1 | The transfer of the ink images is unsatisfactory even in the low color density printing region. |

The test results of the examples and comparative examples are shown in Table 1.

TABLE 1

| | Item | | | | | | | |
|---|---|---|---|---|---|---|---|---|
| | | | Surface roughness | | | | Prevention of | |
| | | | | Center Arithmetical | Color density of ink images | | color gaps in ink images in | |
| Example No. | Compression modulus of elasticity (kgf/cm$^2$) | Maximum strain | Maximum height (Ry) ($\mu$m) | mean roughness (Ra) ($\mu$m) | low color density printing region | High color density printing region | moderate color density printing region | Ink-transfer property |
| Example | | | | | | | | |
| 1 | 190 | 0.37 | 26 | - | 0.28 | 0.95 | 4 | 4 |
| 2 | 590 | 0.12 | 12 | — | 0.32 | 1.21 | 4 | 4 |
| 3 | 410 | 0.17 | 23 | — | 0.60 | 1.43 | 4 | 4 |
| 4 | 390 | 0.16 | 45 | — | 0.20 | 0.85 | 2 | 4 |
| Comparative Example | | | | | | | | |
| 1 | 780 | 0.06 | 12 | — | 0.41 | 0.58 | 3 | 2 |
| 2 | 960 | 0.05 | 6 | — | 0.45 | 0.38 | 2 | 1 |
| Example 5 | 630 | 0.10 | 19 | 2.9 | 0.65 | 1.27 | 4 | 4 |
| Example 6 | 410 | 0.13 | 50 | 5.2 | 0.20 | 0.81 | 2 | 4 |

The recording material of the present invention is suitable for electro-coagulation printing in which an ink capable of gelling when charged with electricity is applied between a portion of a positive rotary cylindrical metal electrode and a plurality of negative needle-shaped electrodes to form an ink layer on the portion of the positive cylindrical electrodes, an electric differential potential is applied imagewise between the positive and negative electrodes to coagulate the ink layer imagewise, and the coagulated ink images are transferred from the positive electrode to a recording surface of a recording material. The recording material of the present invention can record thereon coagulated ink images having a high quality with a high reproducibility. Since the recording material of the present invention has a high cushioning property, the coagulated colloidal ink can be rapidly absorbed in the recording material. Also, when the roughness of the recording surface is controlled to a maximum height (Ry) of 35 $\mu$m or less or to an arithmetical mean roughness (Ra) of 4 $\mu$m or less, the resultant recording surface can record the ink images having a high print quality. The recording material of the present invention is useful for high speed printing, for example, of newspaper and magazine printings or for small lot printings of, for example, direct mail catalogues and advertisements on demand.

What is claimed is:

1. An electro-coagulation printing method comprising:

feeding an ink comprising a polymeric resin, a coloring material and a medium comprising water between a plurality of needle-shaped electrodes and a portion of a rotary cylindrical metallic electrode facing the needle-shaped electrodes, to form an ink layer on the rotary cylindrical metal electrode;

applying electric differential potentials imagewise between the needle-shaped electrode and the rotary cylindrical metallic electrode, to generate metal ions and coagulate the ink layer imagewise by the metal ions;

removing non-coagulated portions of the ink layer from the rotary cylindrical metal electrode; and transferring the coagulated imagewise ink portions on the rotary cylindrical metal electrode onto a recording surface of a recording material having a compression modulus of elasticity of 150 to 600 kgf/cm$^2$ in the direction of the thickness of the recording material, and exhibiting a maximum strain of 0.1 to 0.4 generated under a pressure of 40 kgf/cm$^2$ in the thickness direction of the recording material.

2. The electro-coagulating printing method as claimed in claim 1, wherein the recording material comprises at least one member selected from the group consisting of paper sheets, synthetic paper sheets, nonwoven fabrics and film sheets, and has a recording surface which has a roughness maximum height (Ry) of 10 to 30 $\mu$m at a standard reference length of 2.5 mm, determined in accordance with Japanese Industrial Standard B 0601.

3. The electro-coagulation printing method as claimed in claim 1 or 2, wherein the recording material comprises a support and an ink receiving layer, formed on a surface of the support, comprising (1) fine porous pigment particles having a BET specific surface area of 40 to 1000 m$^2$/g and an average particle size of 0.01 to 15 $\mu$m and a (2) a binder, and having a dry weight of 3 to 30 g/m$^2$.

4. The electro-coagulation printing method as claimed in claim 1 or 2, wherein the recording material is a paper sheet produced from pulp slurry containing a mechanical pulp which contains 20% by weight or more of softwood pulp.

5. The electro-coagulation printing method as claimed in claim 1 or 2, wherein the recording material is a sized paper sheet produced by subjecting a pulp slurry containing mechanical pulp to a paper-forming procedure and coating the resultant paper sheet with an external surface treatment agent containing at least one member selected from the group consisting of aqueous starch solutions, weak cationic acrylate emulsions, aqueous solutions of ammonium salts of styrene-maleic acid copolymers and aqueous polyvinyl alcohol solutions.

* * * * *